US008302584B1

(12) United States Patent
Lu

(10) Patent No.: US 8,302,584 B1
(45) Date of Patent: Nov. 6, 2012

(54) RAIL GUN LAUNCHER

(76) Inventor: Weimin Lu, Novi, MI (US)

( * ) Notice: Subject to any disclaimer, the term of this patent is extended or adjusted under 35 U.S.C. 154(b) by 426 days.

(21) Appl. No.: 12/726,796

(22) Filed: Mar. 18, 2010

(51) Int. Cl.
*F41B 6/00* (2006.01)

(52) U.S. Cl. ..... 124/3; 310/12.07

(58) Field of Classification Search ..... 124/3; 89/8; 310/12.07

See application file for complete search history.

(56) References Cited

U.S. PATENT DOCUMENTS

| | | | | |
|---|---|---|---|---|
| 4,343,223 | A | 8/1982 | Hawke et al. | |
| 4,467,696 | A * | 8/1984 | McNab et al. | 89/8 |
| 4,698,532 | A | 10/1987 | Ross | |
| 4,754,687 | A | 7/1988 | Kemeny | |
| 4,858,511 | A | 8/1989 | Jasper, Jr. | |
| 4,922,800 | A | 5/1990 | Hoffman | |
| 4,926,741 | A | 5/1990 | Zabar | |
| 4,928,572 | A | 5/1990 | Scott et al. | |
| 4,944,212 | A | 7/1990 | Hilal | |
| 4,960,760 | A | 10/1990 | Wang et al. | |
| 5,005,462 | A | 4/1991 | Jasper, Jr. et al. | |
| 5,017,549 | A | 5/1991 | Robertson | |
| 5,125,321 | A | 6/1992 | Cowan, Jr. et al. | |
| 5,173,568 | A | 12/1992 | Parmer | |
| 5,237,904 | A | 8/1993 | Kuhlmann-Wilsdorf | |
| 5,297,468 | A | 3/1994 | Dreizin | |
| 5,375,504 | A | 12/1994 | Bauer | |
| 5,431,083 | A | 7/1995 | Vassioukevitch | |
| 5,454,289 | A | 10/1995 | Bacon et al. | |
| 5,847,474 | A | 12/1998 | Gruden et al. | |
| 6,142,131 | A | 11/2000 | Wortman et al. | |
| 6,622,713 | B1 | 9/2003 | Thomas | |
| 6,757,187 | B2 | 6/2004 | Hoenigschmid | |
| 6,775,187 | B1 | 8/2004 | Hamilton et al. | |
| 7,077,047 | B2 * | 7/2006 | Frasca | 89/8 |
| 7,348,591 | B2 | 3/2008 | Yamauchi et al. | |
| 7,398,722 | B1 * | 7/2008 | Sims, Jr. | 89/8 |
| 7,459,801 | B2 | 12/2008 | Shimoyama et al. | |
| 2005/0140213 | A1 * | 6/2005 | Miyamoto et al. | 310/12 |
| 2005/0253464 | A1 * | 11/2005 | Sugita et al. | 310/12 |
| 2008/0053299 | A1 | 3/2008 | Taylor | |

OTHER PUBLICATIONS

Harry Fair, "The Electromagnetic Launch Technology Revolution", Magnetics Magazine, Winter 2003, Webcom Communications Corp., Greenwood Village, CO., USA.

Ian R. McNab, "Launch to Space with an Electromagnetic Railgun", IEEE Transactions on Magnetics, vol. 39, No. 1, Jan. 2003, pp. 295-304.

W.R. Snow et al., "Design Criteria for Brush Communication in High Speed Traveling Wave Coilguns", IEEE Transaction on Magnetics, vol. 27, No. 1, Jan. 1991, pp. 654-658.

* cited by examiner

*Primary Examiner* — Gabriel Klein

(74) *Attorney, Agent, or Firm* — Carrier Blackman & Associates, P.C.; Joseph P. Carrier; William D. Blackman

(57) ABSTRACT

A rail gun launcher consists of an armature where a magnetic core with a multiple turn conductive coil, two parallel conductive rails on which terminals of the coil contact and slide, and a non-magnetic conductive barrel enclosing the rails and the armature. The coil partially encloses the magnetic core to shift magnetic equilibrium. When an AC power source is connected to the rails, the coil generates a source magnetism around the coil as well as an induced magnetism on the conductive barrel in an opposite direction through the magnetic core. The source magnetism and the induced magnetism are shifted in magnetic equilibrium and in opposite direction thereby repelling the armature forward. This repulsive force travels with the armature and is continuous from breech to muzzle and propels the armature forward to a high velocity without control circuitry or commutation.

19 Claims, 5 Drawing Sheets

RAIL GUN LAUNCHER

BACKGROUND OF THE INVENTION

1. Field of the Invention

The present invention relates to an improved rail gun launcher having much greater efficiency and durability in comparison to conventional rail gun launchers. More particularly, to such a rail gun launcher with a unique multi-turn armature structure which can be continuously accelerated to a hypervelocity (a velocity approximately 3,000 meters per second or greater) in a very efficient manner involving much less power consumption and a comparatively smaller power source than has been previously possible, and wherein the overall structure of the rail gun launcher is relatively uncomplicated.

2. Description of the Background Art

Known electromagnetic accelerators have been designed to accelerate and launch projectiles at high velocities. An example of such an electromagnetic accelerator is a conventional rail gun comprising parallel conductive rails (which are fixed in position) and a conductive armature (or projectile) which is accelerated to great speeds sliding or rolling along the conductive rails when a very large power source such as a million amps is connected across the rails. The rails and the armature together form a closed single turn electrical circuit. When the parallel conductive rails are connected to the large power source, the conductive rails allow a large electric current to pass through the armature. Electric current runs from one terminal of the power source, up one conductive rail, across the armature and down the other conductive rail to the other terminal of the power source. This flow of the current creates a powerful magnetic field between the conductive rails and the projectile. This magnetic field in connection with the current across the armature creates a Lorentz (or propulsion) force which substantially continuously accelerates the projectile along the rails away from the power source until the armature reaches very high speed and is launched.

An example of such a conventional rail gun is found in U.S. Pat. No. 4,928,572 to Scott issued on May 29, 1990, which discloses an electromagnetic projectile launcher using a pulsed AC generator with a power source. The generator is operative to supply a relatively low current pulse to initially accelerate the armature after which an extremely high current pulse is applied for main acceleration. The pre-acceleration pulse may be derived from an auxiliary winding on the generator or may be provided by a relatively smaller generator operated in synchronism with the main generator or physically coupled thereto.

Another example of such a conventional rail gun is found in U.S. Pat. No. 5,297,468 to Dreizin issued on May 29, 1994, which discloses a railgun apparatus for accelerating a projectile having a conductive region. The railgun comprises a power source for providing a current impulse and at least two elongate generally parallel rails. The rails include a first layer comprising a highly conductive material and a second layer comprising a highly resistive layer. The second layer has a resistivity that varies along the length of the rails and is so sized and arranged as to contact the conductive region of the projectile. The power source is switchably connected to the first layer of the rails. When the current impulse is applied to the rails with the projectile therebetween, the current impulse is spread over the conductive region of the projectile to reduce the velocity skin effect.

While conventional rail guns are in principle very simple, they have several known disadvantages, making them practically difficult. One known disadvantage is that, since the conventional rail gun involves only a single turn construction with the rails and armature, an extremely high current DC power source is required. Rail guns require the current flowing through the rails and the projectile to be in the magnitude of tens of thousands to millions of amperes in order to generate the high velocity of the projectile which is sought. A related disadvantage is that the extremely high current is required to be generated over a very short period of time. Without such a high current generated over such a short period of time, the armature would fail to be launched at an appropriate velocity. A power source which can generate such a high amount of current over such a short period of time is both large in size and expensive.

Another disadvantage is that since the armature must be in constant physical contact and electrical conductivity with the rails to let electric current flow as the armature is being launched, large amounts of heat are generated between the moving armature and the rails which burns the rails thereby causing significant and rapid wear of the rails. Although the rails are firmly anchored, under the application of very high current such as one million amps the rails will move a very little amount. That very little movement creates a little gap in the contact between the armature and the rails, and the little gap causes arcing which creates the tremendous heat that destroys the rails. Thus, conventional rail guns can only be used for a single operation or a small number of applications due to the damage to the rails caused by launching of the armature. One manner of avoiding burning of the rails via friction heat is use of plasma arcing, but plasma arcing generates even greater heat so that it is not an effective solution to the problem.

Another disadvantage of conventional rail guns is that, because the armature and two rails are connected in a series-type connection electrically, the heat loss on the rails increases while the armatures, which is only a small fraction of the length of the rails, moves along the rails from breech to muzzle. The point at which the power source (which is usually a DC power source) is connected to the rails in the conventional rail guns must be the breech end close to the initial position of the armature. Thus, as the armature moves away from the breech end, the efficiency of the rail gun will decrease as the effective length of the rails, i.e., the distance between the power source and the armature, increases. As a result of this, the efficiency of typical conventional rail guns such as those of Scott and Dreizen is only approximately 10-30%.

In order to reduce the heat loss along the rails, a more advanced type of rail gun uses segmented rails. As with the conventional rail guns described above, a rail gun which uses segmented rails is composed of parallel arranged current-conducting rails which are connected with a high-intensity current source which accelerates the projectile along the length of the rails. However, unlike a conventional rail gun, a segmented rail gun uses many pairs of shorter length rails lined up front to back, with each pair of shorter length rails being connected to a separate power source. Thus, since each pair of rails is connected to a separate power source, the need for a relatively high power source is somewhat alleviated and the efficiency of a typical segmented rail gun is increased from that of a typical conventional rail gun to approximately 40-60%. However, since the segmented rails are arranged front to back and the segmented rails need to have commutation between the rails in order for the projectile to be accelerated long the entire length of the rail gun, segmented rails guns are known to have a problem with electricity arcing between the pairs of rails. Also, complexity of the segmented rail guns is significantly increased because the multiple power sources must be properly connected to the rails and properly switched over time. Examples of such segmented rails guns can be found in U.S. Pat. Nos. 4,343,223 to Hawke et al. issued on Aug. 10, 1982, 4,754,687 to Kemeny issued on Jul. 5, 1988 and 5,431,083 to Vassioukevitch issued on Jul. 11, 1995.

In an effort to improve the efficiency of conventional rail guns, another type of rail gun, called an augmented rail gun, uses multiple parallel rails to increase the magnetic field strength in order to improve the propulsion force acting on the armature. Such an augmented rail gun can be seen in U.S. Pat. No. 5,375,504 to Pauer issued on Dec. 27, 1994. However, with such augmented rail guns, while the propulsion force is increased, the efficiency is decreased/scarified because the total length of the rails is multiplied, and (again) complexity is increased.

A second example of an electromagnetic accelerator is an induction coil launcher, such as a ring launchers or an eddy-current launcher. Induction coil launchers create an induced current on the armature/projectile which repels the source current within the body of the induction coil launcher. The induced current on the projectile causes the projectile to move towards the lesser reaction thereby pushing the projectile forward. Electrical control circuits are used to control the coils on and off, so that the coil(s) adjacent to the projectile is always on while the projectile is moving forward. Such induction coil launchers are disclosed in U.S. Pat. Nos. 5,125,321 to Cowan Jr. et al. issued on Jun. 30, 1992 and 7,111,619 to Schneider issued on Sep. 26, 2006. In both such induction coil launchers, sensors and switches are used to control the coils on and off. While the induction coil launcher initially quickly accelerates the projectile, induction coil launchers have known disadvantages.

For example, due to the high velocity of the projectile which is being accelerated, the switches turning on and off the coils must work at an extremely high speed. Further, each coil inherently has a certain substantial amount of inductance which will prevent precision switching between on and off of the power to the coils. As such, a precision control circuit to turn on and off each coil depending on the position of the projectile must be added to the induction coil launcher. However, such control circuitry for high-speed precision switching with high current has high technical difficulties in any practical application. This becomes especially true when turning off a coil of a section of coils with high current energy stored therein due to inductance. The turning off operation can cause very large arcing by the mechanical switch which causes the contactors to burn, or if extra time is taken to bleed the stored inductance energy, this slows the switching speed. Further, by using switches, an inductive loss usually occurs. Thus, every time a switch turns off the current flow, the stored inductive energy must be converted to heat in order to be dissipated.

Another example of an electromagnetic launcher is a helical coilgun. A helical coilgun consists of an armature coil and a stator coil in coaxial configuration. Such helical coilguns are shown in W. R. Snow et al. "Design Criteria for Brush Commutation in High Speed Traveling Wave Coilguns", IEEE Transaction On Magnetics, vol. 27, No. 1, January 1991, pp 654-658 and U.S. Pat. No. 7,077,047 to Frasca issued on Jul. 18, 2006. In a helical coilgun, rails are used with a sliding contact to supply power and commutators which connect between the armature coil and the stator coil. Current is caused to flow within the armature coil in the opposite direction of current which flows in the stator coil, thus causing the armature coil to be repelled from the stator coil. While the projectile is moving forward, the stator coil or a portion of the stator coil is connected to the projectile and therefore moves forward with the projectile.

A known disadvantage of the helical coilgun is that when the stator coil or section of the stator coil is disconnected from the projectile, there is a large energy discharge. Because of the inductive nature of the coils (as discussed above), the discharged energy creates arcing that wears and burns the commutators and contacts. Further, commutators themselves also have an inductive loss and, just as with the coil launcher, when a current carrying section of the coil turns off, the stored inductive energy must be converted to heat in order to be dissipated.

The present applicant has previously proposed a channel gun electromagnetic launcher as an improvement over the conventionally available electromagnetic launchers, see U.S. Pat. No. 7,614,393. In such channel gun magnetic launcher, conductive rails are disposed in spaced, substantially parallel relation to each other with a plurality of conductive rungs interconnecting the rails, and normally-open switches are associated with the rungs for selectively permitting current flow through different ones of the rungs as an armature/projectile is accelerated along the rails. The non-conductive, magnetic armature moves parallel to the rails without coming into electrical contact with the rails or the rungs of the guide. Current is allowed to flow through the rungs when in the vicinity of the projectile and then being turned off when the projectile is no longer adjacent to the rungs, thereby creating a magnetic field which propels the armature (and any associated projectile) along the guide.

While such previously proposed channel gun magnetic launcher represents a significant improvement over the conventionally known launchers, since the launcher still requires the use of precision switching and associated circuitry, there are practical difficulties in which must be addressed when accelerating a projectile to hypervelocities sufficient to launch the projectile into space, especially for large-scale applications.

Although some of the disadvantages of conventional electromagnetic launching systems have been addressed, as discussed above, a need still exists in the art for an improved, more efficient electromagnetic launching system which more completely addresses all of the disadvantages attendant the conventional systems. In particular, there is a need for such an improved system that may continuously and efficiently accelerate a projectile but which does not involve control circuitry including commutation or switching circuits so as to reduce inductive loss, which reduces rail wear for repeatable use so as to ensure a long working life and permits the use of a comparatively smaller power source.

SUMMARY OF THE INVENTION

The present invention has been created with the intention of meeting the discussed need. Accordingly, an aspect and advantage of the present invention is its ability to overcome the deficiencies in prior art electromagnetic launchers by providing an improved electromagnetic launcher in accordance with the disclosure herein.

According to a first aspect and feature of the present invention, a rail gun launcher is provided for use in accelerating a projectile to hypervelocity (a velocity approximately 3,000 meters per second or greater), the rail gun launcher comprising: an electric power source; a conductive rail device including two members disposed in spaced, substantially parallel relation to each other and operatively connected to the power source; a movable armature operatively connected to the rail device for thereby forming a flowpath for current from the power source; and a non-magnetic, conductive, stationary barrel disposed coaxially with the movable armature and fixed along substantially a full length of the rail device, and the barrel is spaced from the rail device. The armature includes an elongate magnetic core and a multi-turn coil surrounding a portion of the magnetic core.

Such rail gun launcher according to the first aspect and feature of the present invention is very advantageous because it efficiently accelerates the armature, which may also be the projectile, to hypervelocity by induced magnetism with a relatively simple structure not involving commutation or switching devices (hence eliminating the inductive losses associated with such devices). The arrangement of the power source, rail device and armature creates a source magnetism when current flows through the multi-turn coil of the armature, and an equilibrium point for the source magnetism corresponds to an axial middle point of the multi-turn coil. On the other hand, because the conductive barrel is disposed coaxially with the armature, this creates a reversing induced current on the barrel, which in turn creates an induced magnetism having an equilibrium point which corresponds to an axial middle point of the elongate armature core. The equilibrium points for the source and induced magnetism are thus spaced each other. Further, the reversing induced current on the conductive barrel flows in the opposite direction of the current from the power source flowing through the multi-turn coil, and such opposite direction current flows repel each other, thereby continuously accelerating the armature along the rail device because the conductive barrel (as well as the rail device) is fixed. Because the multi-turn coil is in constant/continuous contact with the rails, the magnetic fields are constantly being generated, thereby accelerating the armature along the entire length of the barrel and rail device.

Moreover, since the rail gun launcher according to the first aspect and feature of the present invention includes the armature that includes the multi-turn coil, the rail gun launcher may use a much smaller power source than is required for the conventional single-turn rail guns, e.g., if the armature coil has N turns, the rail gun of the present invention requires only 1/N times the current of the single-turn rail gun for achieving the same propulsion force. Use of the smaller power source, in turn, causes much less heat generation due to the sliding contact between the rails and the armature, whereby it becomes possible to prevent the rails from moving even a very little distance away from each other, and hence to avoid the very damaging electrical arcing caused by any such movement. Thus the rails are not greatly damaged by every launch of a projectile and may be used for numerous launchings.

According to a second aspect and feature of the present invention the barrel may be disposed coaxially outwardly or coaxially inwardly of the armature. If the barrel is disposed coaxially outwardly of the armature, the barrel may include openings formed there through along the length of the barrel to permit airflow into/out of a space between the barrel and the armature. Such openings advantageously minimize undesirable pressure changes in such space as the armature is accelerated. If the barrel is disposed coaxially inwardly of the armature, the armature core may be formed in an elongate tubular shape, with the barrel extending within the tubular core and the rail gun launcher may further include an elongate magnetic rod disposed within the barrel and spaced therefrom, and which extends substantially the full length of the rail device.

According to a third aspect and feature of the present invention the power source may be connected across multiple portions of the rails spaced longitudinally from each other along the rails. For example, if opposite ends of the rails (breech and muzzle ends) are connected to the power source, the resistance attributable to the rails is reduced by half, which also reduces heat loss and improves efficiency of the launcher. Similarly if the opposite ends and the longitudinal middle of the rails are connected to the power source, the resistance of the rails is ⅓ of that when the power source is connected at only one point to the rails, etc.

While the armature itself may be the projectile to be launched by the rail gun, alternatively a projectile may be fixed to the armature for being accelerated along therewith. When the barrel is disposed coaxially outwardly of the armature, a projectile may be secured to either or both axial ends of the armature, and when the barrel is disposed coaxially inwardly of the armature, the projectile may be secured to any portion of the armature.

The rail gun according to the present invention is very advantageous over known electromagnetic launchers such as conventional rail guns and induction coilguns, and desirably combines favorable characteristics of the prior launchers, without the attendant disadvantages. For example, the armature of the present invention is provided with a multi-turn coil for a greater propulsion force, similar to that of a helical coilgun, without the need for commutation or switching devices. Again, the multiple turns of the coil reduces the size of the power source necessary to launch a projectile which reduces the wear of the rails and permits repeated use of the rails for launching many projectiles as discussed above.

As another example, the present invention uses an induced current on the barrel to repel the armature instead of an induced current within the armature like that of an induction coilgun, thereby eliminating the conventional need for high speed, precision-switching devices such as those found in conventional induction coilguns. Thus, the rail gun according to the present invention has a relatively simple structure in comparison to coil gun because in the arrangement of the present invention, it is not required to use a controller, sensors, etc. to activate switches at an appropriate timing, which is contrary to the structure of a coil gun, and results in a significant cost reduction in comparison to the coil gun.

As still another example, the rail gun may use an AC power source which may be connected at several points along the length of the rails. By using AC power instead of a capacitor banked DC power source, as is used in conventional rail guns and in coilguns, the AC power source can be much smaller and therefore much more inexpensive. Again, since the power source can be connected to the rails at any point along the rails, the use of multiple connection points can minimize the heat loss of the rails thereby reducing resistive loss as discussed above.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

DETAILED DESCRIPTION OF THE PRESENT EMBODIMENTS

Figure 1:
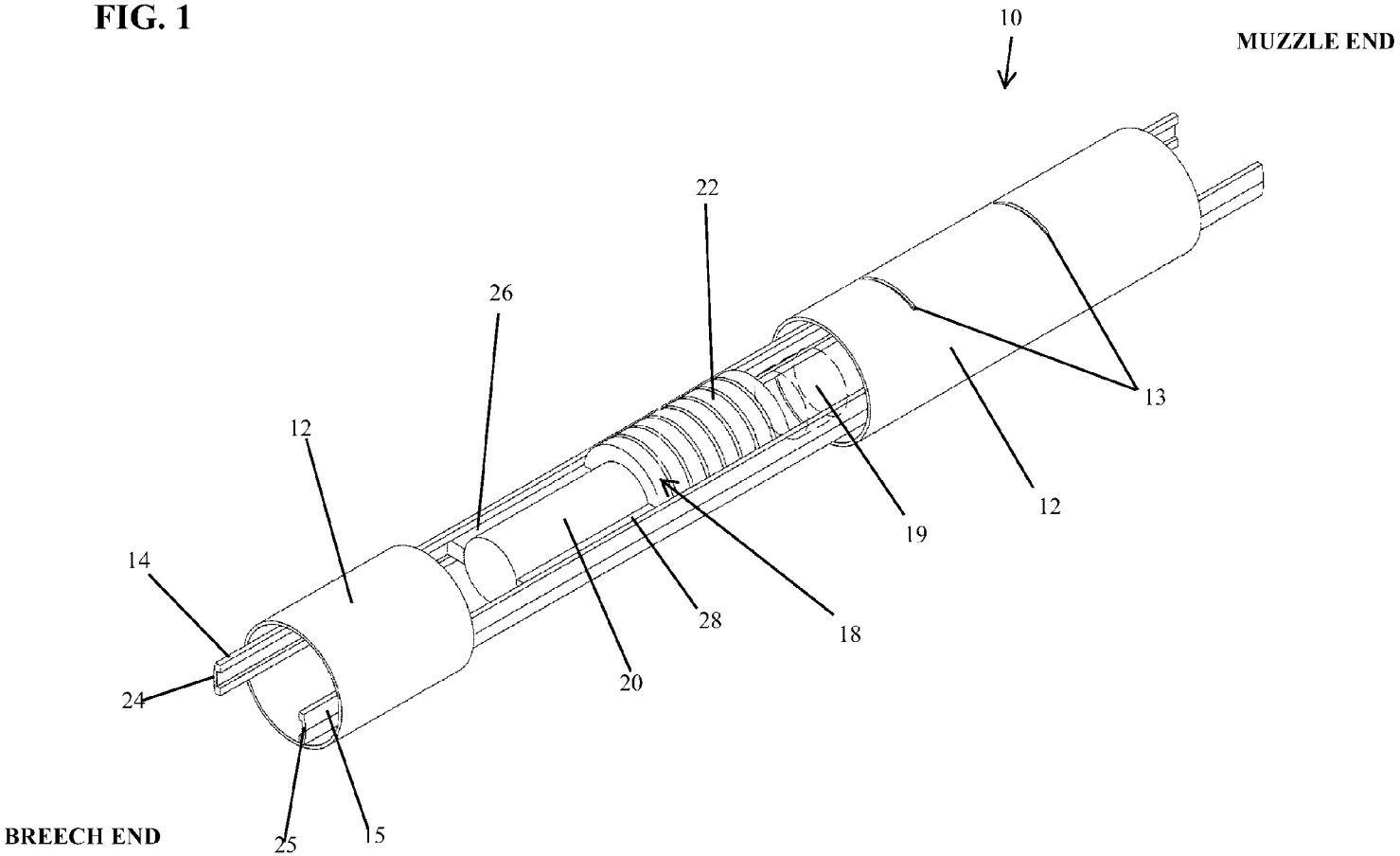
FIG. 1 is a perspective view of a rail gun according to a first illustrative embodiment of the present invention including a barrel disposed outwardly of an armature, and with a portion of the barrel cut away for easy understanding of the structure inside of the barrel.

A number of selected illustrative embodiments of the invention will now be described in some detail, with reference to the drawings. It should be understood that only structures considered necessary for clarifying the present invention are described herein. Other conventional structures, and those of ancillary and auxiliary components of the system, are known and understood by those skilled in the art. These illustrative embodiments are rail guns and various components of such systems.

Referring now to the FIGS. 1-2, there is shown a rail gun according to a first illustrative embodiment of the present invention, generally denoted by reference numeral 10, which is generally comprised of a non-magnetic, conductive body member 12, hereinafter referred to as a barrel, which is substantially tube shaped, a conductive rail device including a pair of non-magnetic, conductive rails 14, 15 disposed in spaced, substantially parallel relation to each other, and an armature 18 disposed in sliding contact with the rails. The rails 14, 15 may be arranged such that they are operatively connected to an electric power source 16 in order to form a flowpath for current flowing from the electric power source 16.

The rails 14, 15 may be formed of non-magnetic, electrically conductive material such as copper. Each of the rails may be formed as a single continuous member or they may be formed such that the rail is broken into several segments wherein the segments are electrically connected together. The rails are spaced from the barrel 12 and may have an insulative material such as plastic provided on outer faces thereof which are opposed to the inside surface of the barrel. As depicted the rails may have a substantially U-shaped cross section with a recess/groove 24, 25 facing inwardly toward the armature 18. Such structure is advantageous because the grooves help to guide the armature 18 as it slides along the rails, and because the grooves increase the effective surface area of the rails for electrical contact with the armature.

The barrel 12 may, like the rails, be made of a non-magnetic, electrically conductive material such as copper or other appropriate non-magnetic, conductive materials. The barrel 12 may be formed as a single continuous piece or it may be formed as several annular segments or rings extending one after the other along the length of the rail gun, and wherein the segments may or may not be physically or electrically connected. The annular/ring shape of the segments is necessary to create the induced current. The barrel 12 is stationary/fixed, disposed coaxially with the movable armature, and extends along substantially the full length of the rail gun 10. The barrel 12 surrounds the rails 14, 15 such that the rails run along the inner wall of the barrel 12. In order to prevent electric current from passing from the rails 14, 15 to the barrel 12, the inner surfaces of the barrel 12 and/or the outer surface of the rails may be insulated, e.g., with a non-conductive plastic coating, such that the rails 14, 15 do not come into electrical contact with the barrel 12. If the barrel 12 is formed as a single continuous member, it may include ventilation openings 13 to freely allow air flow into and out of the space inside of the barrel 12 as the armature 18 move along the rails 14, 15, such that pressure changes, e.g., a vacuum, do not occur inside of the barrel 12 because such changes could undesirably affect movement of the armature.

The armature 18 may include an elongate, magnetic armature core 20 formed in a solid rod shape and having a multi-turn coil 22 formed around a portion of the core, e.g., around one half or one end thereof. The elongate, magnetic armature core 20 may be formed of appropriate ferromagnetic material with minimum eddy current, such as powdered steel or a laminated silicon steel. Laminated silicon steel advantageously minimizes eddy currents generated by the elongate, magnetic armature core 20. Eddy current is a phenomenon whereby an armature is internally heated by the current flowing through the armature. Such heat generation wastes some amount of the flowing current. The multi-turn coil 22 is may be made using a conductive wire, such as a magnet wire or the like, and is insulated from the elongate, magnetic armature core 20. While the armature 18 itself may be propelled from the muzzle end of the rail gun, a projectile 19 could be fastened to the armature 18, e.g., at a front end and/or rear end of the armature 18, or to another exposed portion of the armature using appropriate fasteners.

One terminal end of the multi-turn coil may extended to form a first sliding contact 26 of the armature which operatively engages the groove 24 of the rail 14, while the other terminal end of the multi-turn coil may extended to form a second sliding contact 28 of the armature which operatively engages the groove 25 of the rail 15 such that the armature 18 is appropriately guided along the grooves 24, 25 via the contacts 26, 28 as the armature is accelerated along the rail gun.

Figure 2:
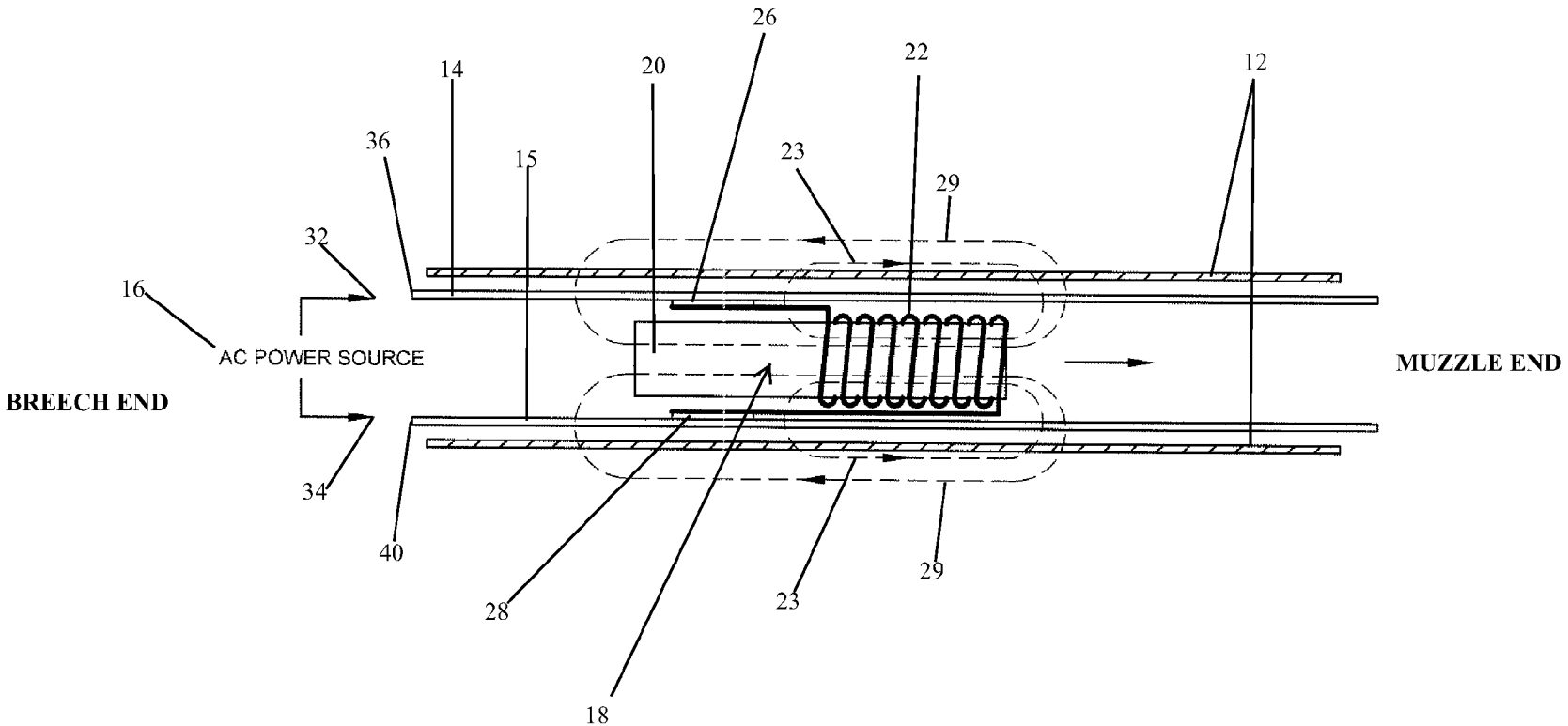
FIG. 2 is a schematic view of the rail gun of FIG. 1 including a power source connected to rails of the rail gun at only one location.

Referring now to FIG. 2, an electrical schematic of the rail gun of the first illustrative embodiment of the present invention is shown in which the rails 14, 15 are electrically coupled to the electrical power source 16. The electrical power source 16 may be an AC power source or a pulsed DC power source, but an AC power source has advantages over a pulsed DC power source, e.g., generally the AC power source is physically smaller in size and less expensive than the pulsed DC power source of comparable output, and the higher the frequency of the AC power source the more the physical size and cost of the power source can be reduced. With an AC power source, because of the large impedance of the armature coil, most of the voltage of the AC power source is across the armature coil regardless of the length of the rails from the power source up to the position of the coil. With a DC power source, the voltage drop across the armature coil is proportional to the length of the rail from the power source up to the position of the coil. If a DC power supply is to be used, to avoid some of the discussed disadvantages, the DC supply may be pulsed.

In a conventional single-turn rail gun the armature is operatively connected between the rails such that current flows along a first rail, across the armature, and down the second rail. As such, the length which the voltage travels across the armature is simply the distance from one rail to another. However, in the present invention, voltage travels along the multi-turn coil, which has a significantly longer length than just the distance from one rail to the other. Thus, based on Kirchhoff's Voltage Law, a higher percentage of voltage is being applied along the multi-turn coil 22 than along the distance of the rails 14, 15, since the multi-turn coil 22 is much longer than the length of the rails 14, 15. As such, the efficiency of the present invention is improved over than of the conventional rail gun.

When the electric power source 16 is activated, electric current flows from the terminal 32 of the electric power source 16 to an electrical contact 36 at the breech end of the first of the longitudinal rails 14. The current then flows along the length of the first rail 14, to the multi-turn coil 22 through the first sliding contact 26 (which is connected to the rail 14 through the groove 24). Electric current then flows through the multi-turn coil 22 and is then supplied to the second rail 15 through the second sliding contact 28 (which is connected to the second rail 15 through the groove 25) where the current then travels back to the other terminal 34 of power source 16 through an electrical contact 40 at the breech end of the second rail 15.

The arrangement of the power source 16, rails 14, 15 and armature 18 creates a source magnetic field 23 when current flows through the multi-turn coil 22 of the armature, and an equilibrium point for the source magnetic field 23 corresponds to an axial middle point of the multi-turn coil 22. On the other hand, because the conductive barrel 12 is disposed coaxially with the armature 18, this creates an induced current flow on the barrel 12 in the opposite direction of the current flowing through the coil, which in turn creates an induced magnetic field 29 having an equilibrium point which corresponds to an axial middle point of the elongate, magnetic armature core 20. Because the induced current on the conductive barrel 12 flows in the opposite direction to that of the current from the power source 16 flowing through the multi-turn coil, the magnetic fields 23, 29 generated by such current flows repel each other. Further, based on the different, fixed axial lengths of the coil 22 and the core 20, as well as the disposition of the coil on one end portion of the core, the equilibrium point of the induced magnetic field 29 is spaced a given distance rearwardly of the equilibrium point for the source magnetic field 23. In effect, the elongate, magnetic armature core 20 of the armature 18 shifts or separates the magnetic equilibrium of the source magnetic field 23 and the induced magnetic field 29. Together, the repelling force and the separation between the equilibrium points of the magnetic fields 23, 29 ensures that the armature 18 will be continuously accelerated in the forward direction along the fixed rails 14, 15 when the power source supplies current to the rail gun.

According to an important aspect of the present invention, the present invention uses only the sliding contacts 26, 28 to supply current to the armature 18. Although the concept of the using sliding contacts on rails is similar to that of a conventional rail gun, because other novel aspects of the present invention permit the use of a much smaller power source, the rail gun of the present invention is able to eliminate or greatly reduce movement of the rails caused by the large power supply, which in turn eliminates or greatly reduces the amount of arcing and heat which is generated along the rails. In a rail gun, a Lorentz force exists on both the conductive armature and on the conductive rails, and because the rails are fixed while the armature movable, the armature is propelled along the length of the rails. In conventional rail gun applications, the rails are firmly anchored so as to theoretically not move. However, under the high amperage (tens of thousands to millions of amps) which is used in conventional rail guns, the rails still move slightly. This slight movement creates a small gap between the armature contact and the rails causing current to arc across the gap. This arcing creates a tremendous amount of heat which rapidly degrades the rails.

The propulsion force is based on the amount of turns of the coil multiplied by the amperage flowing through the turns. In conventional rail guns, there is only one turn of the coil, which necessitates the very large current necessary to propel the armature to a hypervelocity. In the present invention, use of the multi-turn coil allows for a smaller current to be applied to the armature 18 while still allowing the armature 18 to be propelled to a hyper velocity, e.g., if the armature coil has N turns, the rail gun of the present invention requires only 1/N times the current of the single-turn rail gun for achieving the same propulsion force. Thus, with the smaller current being applied, the rails 14, 15 are stationary during use, thereby negating any movement or gaps between the sliding contacts 26, 28 and the rails 14, 15 and thus negating any current arcing. Still further, this allows the present invention use a smaller power source.

Figure 3:
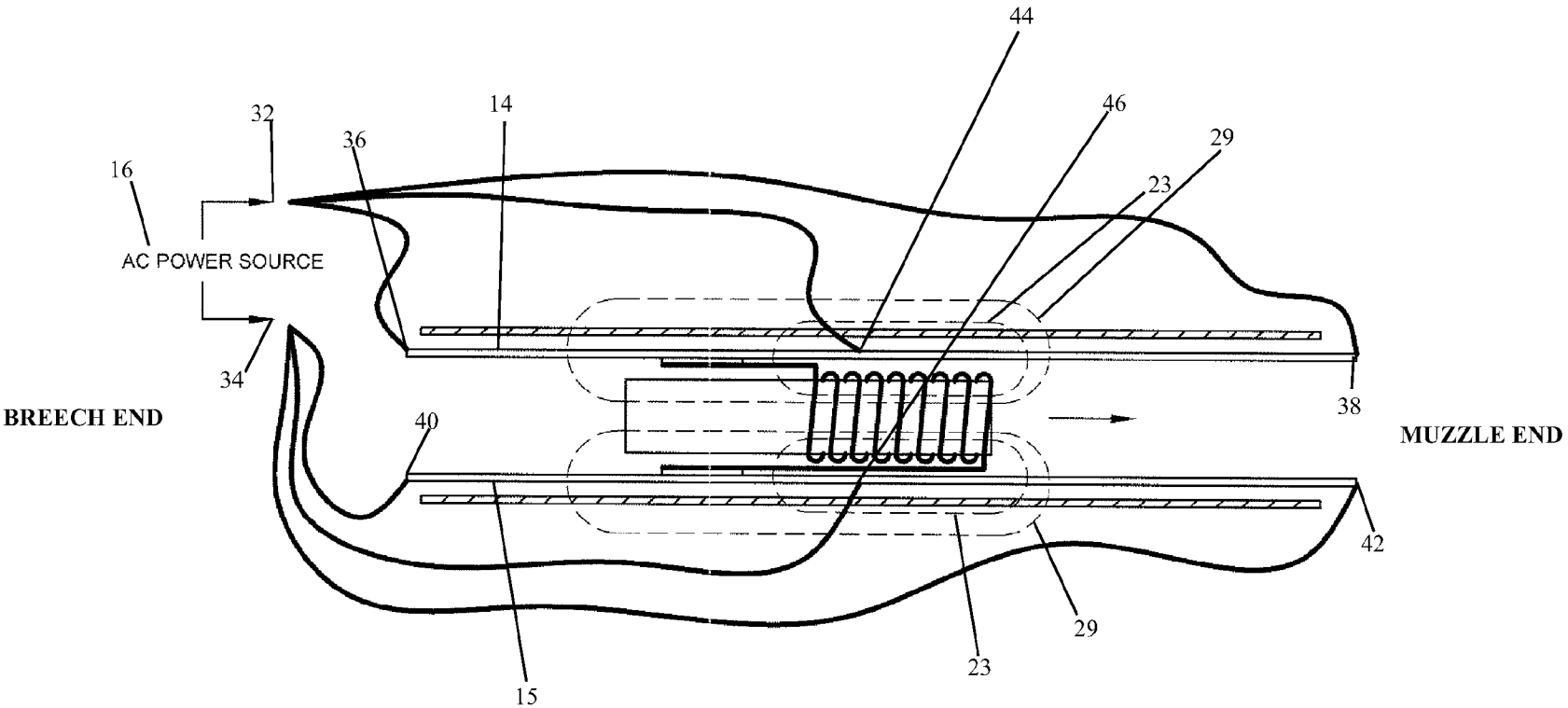
FIG. 3 is a schematic view of the rail gun of FIG. 1 including a power source connected to rails of the rail gun at multiple (three) locations.

According to another important aspect of the present invention, the electric power source 16 may be connected to the rails 14, 15 at multiple points along the rails 14, such as shown in the modified embodiment of FIG. 3. For example, the terminal 32 of the electric power source 16 may be connected to the first rail 14 at the breech end of the rail 14 at a first electrical connection 36 and also at the muzzle end of the rail 14 at a second electrical connection 38, while the terminal 34 of the electric power source may be connected to the breech end of the rail 15 at a first electrical connection 40 and also at the muzzle end of the rail 15 at a second electrical connection 42. Since the current is flowing through both the breech end and the muzzle end of the rails 14, 15, the current must only flow through half of the length of the rails 14, 15 thereby reducing the resistance of the rails 14, 15 by half. Correspondingly, the amount of heat lost due to the resistance of the rails 14, 15 is also reduced and the efficiency of the rail gun is improved. Further still, the terminal 32 and terminal 34 of the electric power source may be connected at various electrical contact points along the length of the rails 14, 15. By way of example, FIG. 3 shows an electrical contact point 44 at the center of rail 14 which can be connected to the terminal 32 of the electric power source 16 and an electrical contact point 46 at the center of rail 15 which can be connected to the terminal 34 of the electric power source 16 to thereby further reduce the resistance (and thus heat loss) of the rails 14, 15. In this instance, the resistance of the rails is ⅓ of that when the power source is connected at only one point to the rails, and this can be to 4, 5, 6, etc. connection points between each of the rails and the power source.

According to still another important aspect of the present invention, the propulsion of the armature 18 is created using a traveling induced magnetism with a repulsive force without the use of commutation or switching devices. The present invention uses a non-magnetic, conductive tube (barrel 12) to create the repelling force which propels the armature 18 in the forward direction along the rails as discussed above.

By applying an AC current to the multi-turn coil 22 through the rails 14,15, a reversing current is induced on the conductive tube (barrel 12) and which circulates on the circumference of the conductive tube (barrel 12) in the vicinity of the multi-turn coil 22. While the armature 18 travels, the induced reversing current of the conductive tube (barrel 12) travels as well. The elongate, magnetic armature core 20 having the multi-turn coil 22 on one end thereof shifts the magnetic equilibrium between the multi-turn coil 22 and the induced reversing current on the conductive tube (barrel 12), creating a repelling force which also travels with the armature 18. By using the conductive tube (barrel 12), the need for commutation or switching devices, and any associated circuitry, is eliminated. Thus resulting in a no or a negligible inductive loss in the present invention. Based on Newton's action-reaction laws, the conductive tube (barrel 12) undertakes the reaction force of the armature 18.

In order to increase or decrease the launching speed of the projectile, the length of the barrel 12 and the rails 14, 15 may be increased or decreased, the effective output of the power source 16 may be varied by varying the number of turns in the coil, varying the number of points to which the power supply is connected to the rails, varying the actual size of the power supply, varying the frequency of the power supply, etc., the size/mass of the projectile 19 may be varied, etc. For example, an optimum repelling force may be determined between the source and induced magnetic fields based on the length and/or size of the armature 20 magnetic core, the size, location, and/or number of turns of the armature coil, the spacing between the armature and the barrel 12, etc.

As will be appreciated, other variations and arrangements of electromagnetic launcher and projectile(s) may be provided which function similarly to the above-described embodiments, and the present invention is intended to encompass these as well.

Figure 4:
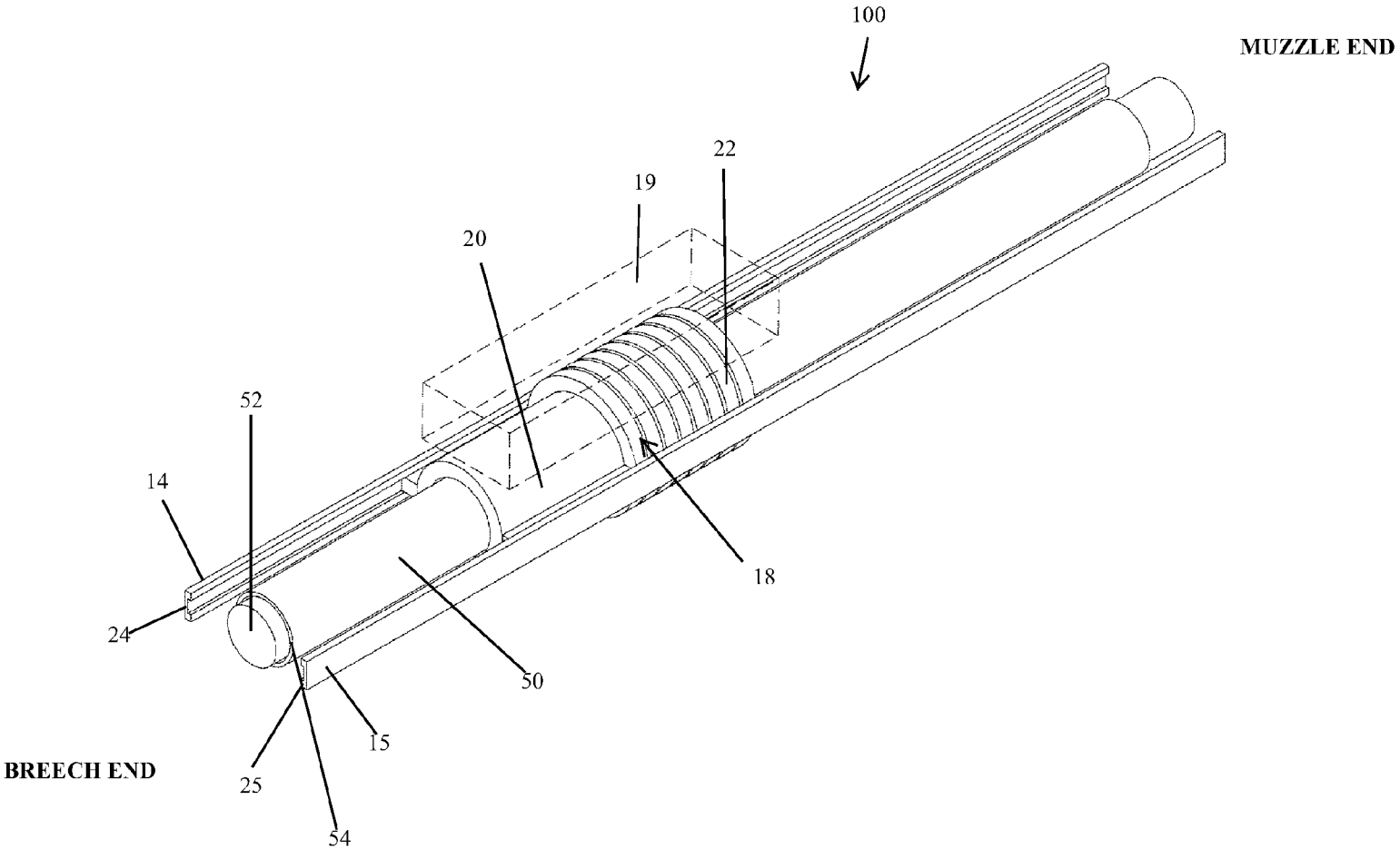
FIG. 4 is a perspective view of a rail gun according to a second illustrative embodiment of the present invention including a barrel disposed inwardly of an armature.
Figure 5:
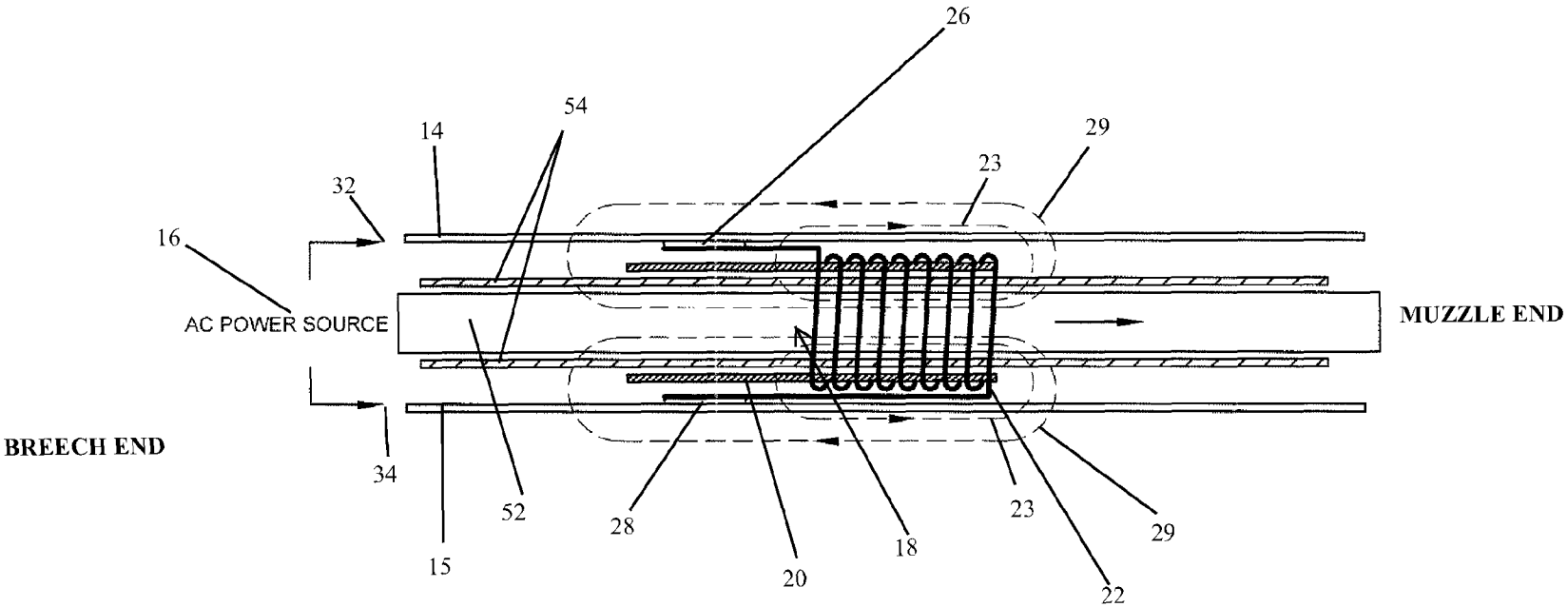
FIG. 5 is a schematic view of the rail gun of FIG. 4 including a power source connected to rails of the rail gun at only one location.

Referring now to FIGS. 4-5, there is shown a rail gun according to second illustrative embodiment of the present invention in which the barrel 50 is disposed inwardly of the armature 18 rather than outwardly thereof as in the embodiment of FIGS. 1-2. Like components in the second embodiment are indicated by like reference numbers and the following discussion focuses primarily on the differences between the two embodiments.

In this second embodiment the magnetic core 20 of the armature may be formed as an elongate tubular member such that the barrel 50 may extend coaxially there through, and the barrel 50 may comprise not only an elongate tube 54 of nonmagnetic, electrically conductive metal such as copper as in the first embodiment, but also an elongate magnetic rod 52 extending coaxially inside of the barrel 50 for substantially the entire length of the rail gun. The magnetic rod 52, like the armature core 20 may be made of a ferromagnetic material such as powdered steel, laminated silicon steel having minimum eddy current, etc. The barrel 50 is spaced out of contact with the elongate, magnetic armature core 20 and with the nonmagnetic, conductive tube 54. Since the barrel 50 is positioned inside of the elongate, magnetic armature core 20, a projectile 19 may be fastened (using conventional fastening techniques) to the armature 18 on almost any portion of the armature 18 instead of only in front or behind the armature 18 as in the first embodiment. Also, the barrel's conductive tube 54 may be formed as a single continuous member with out any vent openings such as the openings 13 of the first embodiment because the armature/projectile is not enclosed within the tube 54, although vent openings could be included as a means of reducing the mass of the tube 54. Alternatively, the barrel's conductive tube 54 may be formed as a plurality of annular segments or rings just as the barrel 12 of the first embodiment as discussed above.

While its structure is somewhat different as discussed above, the rail gun 100 of this second embodiment functions essentially the same as the rail gun 10 of the first embodiment, and achieves all of the advantages achieved by the rail gun 10.

According to this illustrative embodiment of the present invention, when current is supplied to the rails 14, 15 through the electric power source 16, the current is transferred to the multi-turn coil 22 through the sliding contacts 26, 28. Similar to the first illustrative embodiment, current flowing through the multi-turn coil 22 generates a source magnetic field 23 with the magnetic equilibrium being in the center of the multi-turn coil 22. The current flowing through the multi-turn coil 22 also induces current on the conductive tube 54 of the barrel 50 in the presence of the magnetic armature core 18 and magnetic rod 52 such that an induced current flows in an opposite direction to the current flowing within the multi-turn coil 22. Because the elongate, magnetic armature core 20 and the magnetic rod 52 are in the path of the induced magnetic field 29, the induced magnetic equilibrium of the induced magnetic field 29 is in the center of the elongate, magnetic armature core 20. The two magnetic equilibriums, the source magnetic equilibrium and the induced magnetic equilibrium, are shifted by the elongate, magnetic armature core 20 such that they repel each other. Since the barrel 50 is stationary, the armature 18 is then displaced due to the force generated the two magnetic equilibriums pushing away from each other. Because the multi-turn coil 22 is in constant contact with the rails 14, 15, the magnetic field is constantly being generated, thereby accelerating the armature along the entire length of the barrel 50 and rails 14,15 to hypervelocity. Of course the second embodiment rail gun 100 according to the present invention may have a power source which is connected to the rails at multiple points along the length of the rails, just as the power source shown in FIG. 3.

PRACTICAL EXAMPLE OF THE INVENTION

Practical examples of the invention involving the above described embodiments are explained in the examples below.

Example 1

As an example of the embodiment shown in FIGS. 1-2, in calculations comparing the present invention with a conventional rail gun, with an extended length for the gun rails and without accounting for air friction, in an ideal scenario wherein there is no friction, the magnetic force F can be calculated using the Lorentz equation, which is reformatted below as Equation B, in SI units, $$F=L*I*B*N \quad \text{(Equation B)}$$

wherein the magnetic force (F) is measured in Newtons, the length (L) is measured in meters, the current (I) is measured in amperes, the magnetic field (B) is measured in Tesla, and N is the number of turns in the coil. In the present invention, if only one-tenth (1/10) of the current (I) is used, with one hundred (100) turns of the coil, then the magnetic force (F) is ten (10) times greater (F=(I/10)*B*100)=I*B*10) than in the conventional single turn rail gun. In other words, if we have a one hundred (100) turn coil in the present invention, we can achieve ten (10) times more magnetic force (F) using ten (10) times less energy than would be used in a conventional rail gun which uses only a single turn coil.

Example 2

As en example of the embodiment described above in FIGS. 4 and 5, in (again) an ideal scenario wherein there is no friction, the magnetic force F can be calculated using the Lorentz equation, which is reformatted below as Equation B, in SI units, $$F=L*I*B*N \quad \text{(Equation B)}$$

wherein the magnetic force (F) is measured in Newtons, the length (L) is measured in meters, the current (I) is measured in amperes, the magnetic field (B) is measured in Tesla, and N is the total turns in the coil. If the projectile is 0.1 meters in diameter, then the length (L) is 0.1 multiplied by Π (pi=approximately 3.14) which is 0.314 meters. Assuming that the current (I) is 1000 amps and the magnetic field (B) is 0.5 Tesla, then the coil would be made using 1000 turns. Thus, the magnetic force would be F=L*I*B*N=0.314*1000*0.5*1000=157,000 Newtons. If the projectile weighs four (4) kilograms, then the acceleration force (A)=Force/mass (F/m)=157,000/4=39,250 meters per second squared. Thus, if the projectile's beginning velocity is zero, then after 0.2 second, the velocity=Acceleration*time (A*t)=39,250 *0.2=7,850 meters per second (7.85 kilometers per second). When the length of the barrel is S=½ Acceleration*time$^2$=(½A*t$^2$)=½*39,250 *0.2$^2$=785 meters, the kinetic energy at muzzle speed (the speed of the armature at the muzzle end of the rail gun) is E=½ mass velocity$^2$=½mv$^2$=½*4 *7850$^2$=123,245,000 joules or approximately 123 megajoules. The muzzle speed of 7.85 kilometers per second with 123 megajoules of energy is enough to send a projectile of that size to space.

The present invention is not limited in its application to the details of construction and to the dispositions of the components set forth in the foregoing description or illustrated in the appended drawings in association with the present illustrative embodiments of the invention. The present invention is capable of other embodiments and of being practiced and carried out in various ways. In addition, it is to be understood that the phraseology and terminology employed herein are for the purposes of illustration and example, and should not be regarded as limiting.

As such, those skilled in the art will appreciate that the concepts, upon which this disclosure is based, may readily be utilized as a basis for the designing of other structures, methods and systems for carrying out the several purposes of the present invention. It is important, therefore, that the claims be regarded as including such equivalent constructions.

As one example, while the above illustrative embodiments include two non-magnetic, conductive rails which are insulated from the barrel, it is possible, that only a single rail may be used, with the barrel being used as the second rail. However, instead of the electric power source being connected to two rails, the electric power source would connect to the barrel and the single rail. The first sliding contact of the multi-turn coil would be in contact to the barrel instead of to a rail, while the second sliding contact would still be in connect with the rail, in order to simplify the design of the rail gun.

INDUSTRIAL APPLICABILITY

The present invention is preferably applicable when a projectile is being accelerated to a hypervelocity, e.g., launching a projectile to outer space or launching a projectile intercontinentally.

Although the present invention has been described herein with respect to a number of specific illustrative embodiments, the foregoing description is intended to illustrate, rather than to limit the invention. Those skilled in the art will realize that many modifications of the preferred embodiment could be made which would be operable. All such modifications, which are within the scope of the claims, are intended to be within the scope and spirit of the present invention.

What is claimed is:

1. A rail gun comprising:

an electric power source;

a conductive rail device including a plurality of conductive rails disposed in spaced, substantially parallel relation to each other and operatively connected to the power source;

a movable armature operatively connected to the rail device and forming a flowpath for current from the power source; and a fixed, non-magnetic, conductive barrel disposed coaxially with the movable armature and extending along substantially a full length of the rail device;

wherein the armature comprises an elongate ferromagnetic core, and a multi-turn coil disposed about a portion of the ferromagnetic core; and wherein the barrel is spaced away from the rail device.

2. The rail gun according to claim 1, wherein the multi-turn coil is disposed about one end portion of the ferromagnetic core.

3. The rail gun according to claim 1, wherein each of conductive members of the conductive rail device has a groove which extends along a longitudinal length of the rail gun, a first terminal of the multi-turn coil contacts the groove of one of the conductive members, and a second terminal of the multi-turn coil contacts the groove of another of the conductive members so that the armature is guided by said grooves as the armature is accelerated along the rail device.

4. The rail gun according to claim 1, wherein the barrel is disposed coaxially outwardly of the armature and the barrel is provided with a plurality of openings formed there through along the length of the barrel.

5. The rail gun according to claim 1, wherein the elongate ferromagnetic core of the armature is formed in an elongate tubular shape and the barrel is disposed coaxially within the elongate ferromagnetic core.

6. The rail gun according to claim 5, further comprising a magnetic rod inside the barrel wherein the magnetic rod is made of a ferromagnetic material having a minimum eddy current.

7. The rail gun according to claim 1, further comprising a projectile to be launched by the rail gun which is secured to the armature.

8. The rail gun according to claim 1, wherein the electric power source is an AC power source.

9. The rail gun according to claim 1, wherein each of the conductive members of the rail device is connected to the power source at multiple connection points along the length of the conductive member.

10. The rail gun according to claim 1, wherein the ferromagnetic core of the armature is made of a ferromagnetic material having a minimum eddy current.

11. The rail gun according to claim 1, wherein the barrel comprises a plurality of annular segments extending sequentially along the length of the rail device.

12. A method of continuously accelerating a projectile to hyper velocity using a rail gun launcher, comprising the steps of:

operatively connecting a conductive rail device which includes two rails disposed in spaced, substantially parallel relation to each other to an electric power source;

operatively connecting a movable armature to the rail device such that the armature and rail device form a flowpath for current from the power source, and such that the armature can be accelerated along the rail device by the power source; and fixedly disposing a non-magnetic, conductive barrel coaxially with the movable armature and so that the barrel extends along substantially a full length of the rail device; securing a projectile to be launched to the movable armature; activating the electric power source to accelerate the movable armature and projectile, wherein the armature comprises an elongate ferromagnetic core, and a multi-turn coil disposed about a portion of the ferromagnetic core; and wherein the barrel is spaced away from the rail device.

13. The method of continuously accelerating a projectile to hyper velocity using a rail gun launcher according to claim 12, wherein the multi-turn coil is disposed about one end portion of the ferromagnetic core.

14. The method of continuously accelerating a projectile to hyper velocity using a rail gun launcher according to claim 12, wherein each of conductive members of the conductive rail device has a groove which extends along a longitudinal length of the rail gun, a first terminal of the multi-turn coil operatively contacts the groove of one of the conductive members, and a second terminal of the multi-turn coil operatively contacts the groove of another of the conductive members so that the armature is guided by said grooves as the armature is accelerated along the rail device.

15. The method of continuously accelerating a projectile to hyper velocity using a rail gun launcher according to claim 12, wherein the barrel is disposed coaxially outwardly of the armature and the barrel is provided with a plurality of openings formed there through along the length of the barrel.

16. The method of continuously accelerating a projectile to hyper velocity using a rail gun launcher according to claim 12, wherein the elongate ferromagnetic core of the armature is formed in an elongate tubular shape and the barrel is disposed coaxially within the elongate ferromagnetic core.

17. The method of continuously accelerating a projectile to hyper velocity using a rail gun launcher according to claim 12, wherein each of the conductive members of the rail device is connected to the power source at multiple connection points along the length of the conductive member.

18. The method of continuously accelerating a projectile to hyper velocity using a rail gun launcher according to claim 12, wherein the ferromagnetic core of the armature is made of a ferromagnetic material having a minimum eddy current.

19. A method of continuously accelerating a projectile to hyper velocity using a rail gun launcher according to claim 12, wherein the barrel comprises a plurality of annular segments extending sequentially along the length of the rail device.

* * * * *